73-151 SR
6/15/82 OR 4,334,429

United States Patent [19]
Breton et al.

[11] 4,334,429
[45] Jun. 15, 1982

[54] METHOD AND APPARATUS FOR LOCATING THE POSITION OF A DRILL CORE SAMPLE

[75] Inventors: Jean-Paul R. H. Breton, Jargeau; Pierre C. Thomassin, Salbris; Bernard E. Villeneuve, Romorantin, all of France

[73] Assignee: Bureau de Recherches Geologiques et Minieres, Paris, France

[21] Appl. No.: 161,991

[22] Filed: Jun. 23, 1980

[30] Foreign Application Priority Data

Jun. 26, 1979 [FR] France ..... 79 16444

[51] Int. Cl.[3] ..... E21B 49/00
[52] U.S. Cl. ..... 73/151; 33/304
[58] Field of Search ..... 73/151; 175/403; 299/1; 33/302, 304

[56] References Cited

U.S. PATENT DOCUMENTS 1,932,612 10/1933 Williston ..... 33/302 X
2,003,345 6/1935 Maris ..... 33/304 X
3,622,971 11/1971 Arps ..... 33/302 X

*Primary Examiner*—Jerry W. Myracle
*Attorney, Agent, or Firm*—Sughrue, Mion, Zinn, Macpeak and Seas

[57] ABSTRACT

The invention makes it possible to determine impressions independently of a core cutting machine.

A hooking device makes it possible to lower the assembly by a simple cable owing to the provision for an additional mass. The position of the eccentric is ascertained by the penetration of pointed rods into a disc under the pressure of one or more of several feelers which releases the rod carrier.

The device may be used for the precise determination of the line of greatest slope relative to the impressions even for inclines varying from the vertical by less than 10°.

13 Claims, 4 Drawing Figures

Figures 1, 2, 3, 4:
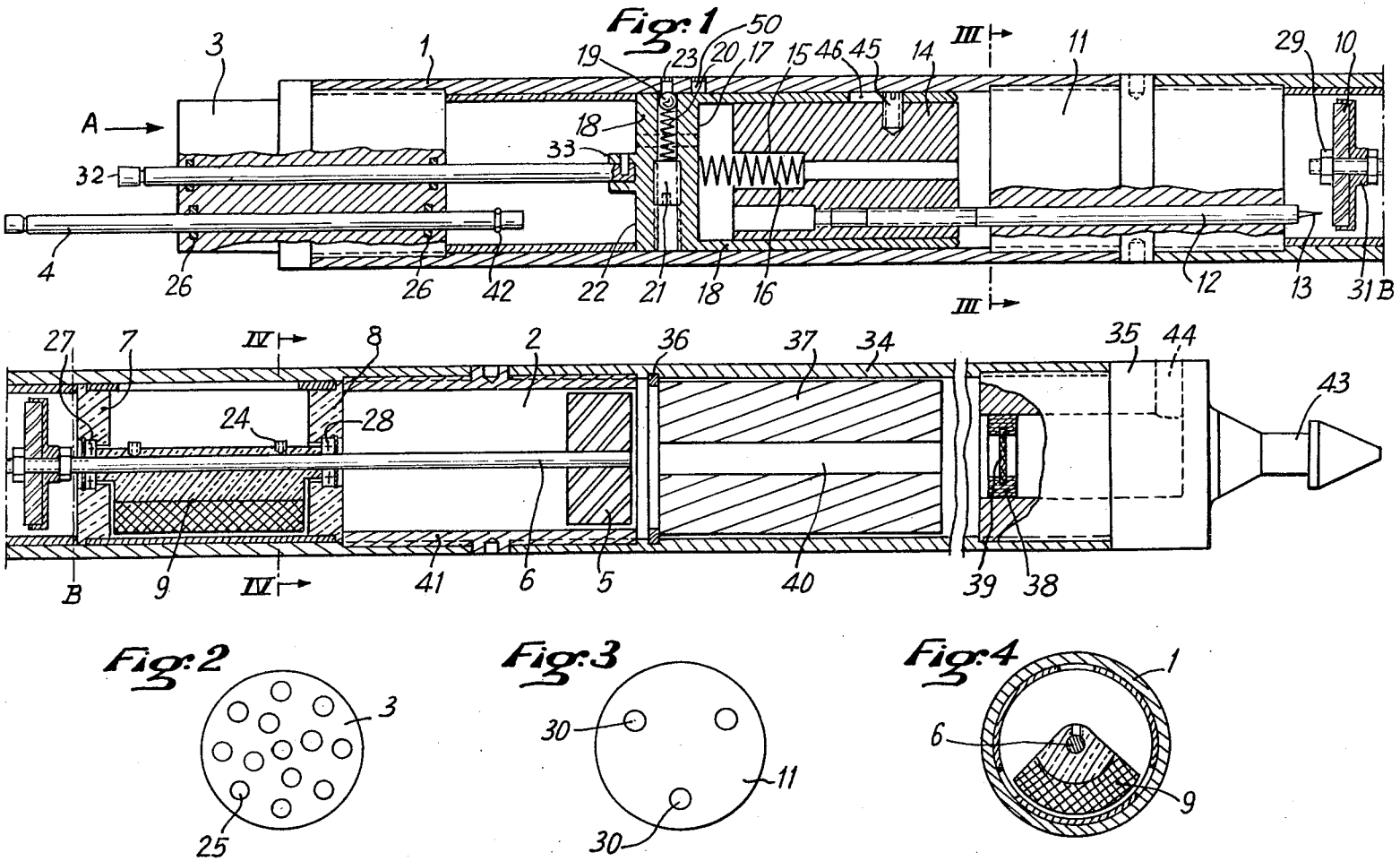

A
B
III
IV
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
50

METHOD AND APPARATUS FOR LOCATING THE POSITION OF A DRILL CORE SAMPLE

The present invention relates to a method and apparatus for locating the position of a drill core sample relative to the lower line of greatest slope of a drilling.

Devices are already known for discovering the lower line of greatest slope of a corer by means of a device forming part of the core cutting tool or inserted therein.

These devices have the disadvantage of reducing the useful length of the corer as a result of the necessity of removing the base of the device employed from the tip of the core in the course of formation and the lack of precision in the determination of the line of greatest slope of the cylindrical body relative to the corresponding line of the corer.

The present invention therefore concerns a process for discovering the position of a drill core, in accordance with which the discovery of the lower line of greatest slope is effected by means of a device independent of the corer.

The advantage of such a process is that, on the one hand, the disadvantage which has just been indicated is eliminated, since it is possible to free all the space occupied by the core cutting tool, the locating device being independent; on the other hand, it has the advantage of considerably reducing the time for reassembling the device, since, being no longer connected to the core cutting tool, it no longer depends on the train of rods, and can consequently be taken down and remounted on the cable.

The invention also includes a device for carrying out the above process which is provided at its base with sliding feelers for the determination of the impressions, the locating device proper being provided with an additional weight ensuring the more or less deep penetration of various feelers.

The additional masses facilitate the descent of the device and the taking of an impression of the bottom of the drilling. A mobile eccentric may be mounted about the axis of the device making it possible to indicate the lower line of greatest slope of the device in the drilling.

The additional masses can lock the position of the eccentric by means of an assembly of points penetrating into a disc of cork or similar material, attached to the eccentric.

Even for inclines closer to the vertical than 10°, great precision is obtained in this manner, this precision being at least of the order of 1° to 3° for inclines greater than 10°.

The device can be made more reliable, whatever the coring conditions, by making the device water-tight and by filling it with water in such manner that equilibrium of the pressures is achieved by means of a passage fitted with a filter. Whatever the depth may be, the feelers can release at the end of the movement of the device and under the action of the weight of the assembly itself. Also the means of blockage of the disc also block further movement of the indicator and the eccentric, as these elements are coupled directly to the disc.

An example of the present invention will now be described with reference to the attached drawings in which:

FIG. 1 is a schematic view, partly in an axial section, of a core sample locating device, FIG. 2 is a view at the end of the lower extremity in the direction of the arrow A of FIG. 1, FIG. 3 shows a section taken on the line III—III of FIG. 1, and FIG. 4 shows a section taken on the line IV—IV of FIG. 1.

The device shown in FIG. 1 comprises a cylindrical envelope 1, the upper part of which carries an indicator unit 2 and the lower part of which is sealed by an assembly 3 carrying feelers 4. The number of these feelers may be for example from 8 to 12, the purpose thereof being to obtain an adequate representation of the bottom of the drilling.

The indicator unit 2 terminates in an indicator 5 connected to the displaceable shaft 6 mounted on the two plates 7 and 8 fitted with roller bearings 27 and 28. The shaft 6 is also connected to an eccentric 9 and an immobilising platform 10 capable of being perforated a great number of times without risk of laceration and deformation after perforation. It may be a disc of any material responding to this condition: cork for example, non-rigid plastics material, or other material of sufficient firmness. The disc may be changed periodically if desired after a large number of operations. For this purpose the disc 10 is mounted on the support 31 by means of the nut 29. The shaft 6 is connected to the eccentric 9 by screws 24.

A guide 11, FIGS. 1 and 3, disposed below the plate 10 ensures by the passages 30 the guiding of the drilling mechanism which, in the illustrated embodiment, is formed by bars 12 carrying at their upper end points 13. This assembly of bars is connected to the cylinder 14, the lower center part 15 of which is hollowed out to serve as a recess for a spring 16 bearing on the bottom 17 of a sliding cylinder 18 disposed between the cylinder 14 and the cylindrical envelope 1.

The sliding cylinder 18 is normally retained in a position remote from the guide 11 by means of a retaining ball 19 located in a small spherical cavity 23 within the envelope 1. The ball 19 is biased by a spring 20 disposed in the hollowed-out cylindrical portion 21 located between the inner face 17 and outer face 22 of the base of the sliding cylinder 18.

The assembly 3 carrying feelers 4 is formed by a cylindrical block provided with an assembly of cylindrical bores 25 (FIG. 2) within which are disposed ring seals 26 simultaneously ensuring the seal of the device and the sliding of the feelers 4 under the effect of a sufficient force obtained from the additional masses.

For this purpose the position locating assembly is secured to a ballast carrying tube 34. By way of example, the tube 34 may be screwed to a connection 41, itself secured to the cylindrical envelope 1 of the device. The ballast 37 rests on the ring 36 and is formed with an inner passage 40 leading to a filter 39 carried by the band 38. A cap 35 encloses the ballast carrying tube 34 and is also formed with a hooking device 43 as well as with openings 44 communicating with the filter 39.

When the assembly of the position locating device 1 and of the ballast carrier 34 is in the condition shown in FIG. 1, that is to say, with the assembly of feelers 4 separated from the locking device 19 of the control means 14 for locking the plate 10 indicating the position of the eccentric 9, and the center feeler 32 being connected at 33 to the cylinder 18 locked by the ball 19 at 23, the device is filled with water and it is lowered on the cable. Rings 42 connected to the ends of the feelers 4 make it possible to limit the movement thereof before the device is lowered. Under the weight of the assembly and as a function of the incline of the bottom of the drill hole the feelers 4 are pushed in more or less driving out a certain volume of water through the filter 39. As soon as the central feeler 32 or a feeler 4 strikes the bottom of the cylinder 18, the ball 19 is pushed out of its small spherical cavity 23 to enter, after a slight displacement of the cylinder 18, the spherical cavity 20 of larger dimension in order to ensure a locking action resisting the thrust of the spring 16 when the latter becomes compressed at the end of the impact of the points 13 in the cork disc 10. Screws, such as 45, connected to the guide 14, limit the movement thereof by coming into contact with the periphery of an opening 46.

After the raising of the assembly by means of a cable, it is only necessary to withdraw the ballast-carrying tube 34 in order to learn, by means of the disc 5 kept in position by the points 13 and the disc 10, the position of the feelers relative to the lower line of greatest slope.

Restoration of the assembly is effected by simple traction on the feelers 4 and the feeler 32, the securing of the ballast carrier 34 and refilling with water.

We claim:

1. An apparatus for locating the position of a drill core sample relative to the lower line of greatest slope of a drilling, comprising at least one means for locating impressions of the tip of the core, and means for locating the line of greatest slope relative to said means for locating impressions, said apparatus being lowered on a cable and determining said impressions and said line of greatest slope independently of the position thereof relative to the core cutting device.

2. A device as claimed in claim 1, said apparatus being provided at its base with several sliding feelers for the determination of said impressions, and being provided with an additional weight ensuring accurate penetration of the several feelers.

3. A device as claimed in claim 2, further comprising outer walls, said walls forming a tank for filling with water and including at least one passage which leads to the exterior, said passage being fitted with a filter.

4. A device as claimed in claim 3, wherein said feelers are guided in cylindrical passages provided with ring seals, said several feelers with the exception of the central feeler being capable of a considerable free displacement before coming into contact with a further mechanism, said mechanism, when displaced by contact with one of said displaceable feelers controlling the locking of the device for locating the lower line of greatest slope, said central feeler being connected to said mechanism.

5. A device as claimed in claim 4, wherein said means for determining the lower line of greater slope comprises an eccentric element rotatably controlling an indicator mounted at the end of the apparatus opposed to that carrying the feelers.

6. A device as claimed in claim 5, wherein the eccentric rotatably drives, in addition to said indicator, an eccentric element position locking means disposed on the side of the eccentric opposite to the indicator device.

7. A device as claimed in claim 6, wherein said means for locking the position of the eccentric comprises a disc of perforatable untearable material, said disc receiving perforating points actuated by the displacement of said further mechanism.

8. A device as claimed in claim 7, wherein said perforating points are disposed at the end of rods connected to an assembly movable between a first locking position in which the points are separated from the locking disc, and a second locking position in which the points penetrate the disc, said assembly being connected to said central feeler.

9. A device as claimed in claim 6, comprising additional weights which ensure the release of said further mechanism actuating the means for locking the eccentric.

10. A device as claimed in claim 8, wherein the mechanism for the release of the locking means of the eccentric comprises a cylinder connected to said central feeler, said cylinder being locked by a ball urged partially out of the cylinder by a spring, said ball engaging a recess in a first location of the wall of the device, when said feelers are at rest; said cylinder being unlocked from this initial position under the influence of one or more of said feelers to pass to a second position in which said ball enters a second recess of larger diameter, the distance between said recesses determining the movement of the central feeler and the displacement of said cylinder and being sufficient to ensure the locking of the eccentric.

11. A device as claimed in claim 10, wherein said cylinder includes a central spring driving an assembly of members for locking the eccentric.

12. A device as claimed in claim 3, wherein the assembly includes a lateral wall which can be filled with water, said additional weight being formed by a cylinder containing a ballast, said cylinder being located at the end of a device carrying said means for locating the line of the greatest slope, a channel passing through the ballast terminating in said filter, said channel communicating with the exterior through openings situated below means for making the ballast-carrying cylinder.

13. A method of locating the position of a drill core sample relative to the lower line of greatest slope of a drilling, comprising lowering a locating device into the drilling until feelers thereof are pushed inwardly to contact a cylinder, releasing said cylinder in response to said contact to prevent further movement of an eccentric carried by said locating device, raising said device from the drilling and removing a portion of said device to reveal means indicating the position of said feelers with respect to said lower line of greatest slope.

* * * * *